United States Patent [19]

Boitani

[11] Patent Number: 4,819,351

[45] Date of Patent: Apr. 11, 1989

[54] BOOKCOVER-LIKE FOLDER FOR GUIDED MENU

[76] Inventor: Maria Boitani, Via Bissolati, No. 54, 001870 Rome, Italy

[21] Appl. No.: 41,739

[22] Filed: Apr. 21, 1987

[30] Foreign Application Priority Data

Oct. 31, 1986 [IT] Italy ..... 36223/86[U]

[51] Int. Cl.[4] ..... G09F 3/18

[52] U.S. Cl. ..... 40/642; 40/158.1

[58] Field of Search ..... 40/10 R, 16, 359, 360, 40/158 R, 158 B, 159; 282/11.5 R; 206/472; 229/72; 292/202; 350/241, 256; 434/150, 153, 178

[56] References Cited

U.S. PATENT DOCUMENTS

| | | | |
|---|---|---|---|
| 970,399 | 9/1910 | Sawyer | 40/158 B |
| 1,014,908 | 1/1912 | Sawyer | 40/158 R |
| 1,201,700 | 10/1916 | Cohen | 40/10 R |
| 1,388,333 | 8/1921 | Godard | 40/16 |
| 1,494,512 | 5/1924 | Steiner | 292/202 X |
| 1,993,589 | 3/1935 | Borden | 350/241 |

*Primary Examiner*—Carlton R. Croyle
*Assistant Examiner*—Leonard P. Walnoha
*Attorney, Agent, or Firm*—Wenderoth, Lind & Ponack

[57] ABSTRACT

The present invention relates to a bookcover-like folder or container for a guided menu having an upper and lower sheet joined by a lateral rigid ribbing, the menu provided on the inside part of such sheets. The folder also contains a supplemental sheet having the same size as the lower sheet and being extractable from inside of the same and on which drinks are described that compliment food items on the menu. A further bookcover-like container or folder is provided on the outside surface of the first sheet, and on the inside part of which, on a first internal surface, technical directions are provided for selecting complimentary food items on said menu and drinks, and cultural information is provided on a second internal surface. The bookcover-like folder is designed for aiding customers of first-rate restaurants to determine which of the various courses are best complimented by which of the wines available as well as for illustrating particularly notable places, from a historical or panomaric standpoint, associated with the restaurant.

3 Claims, 2 Drawing Sheets

BOOKCOVER-LIKE FOLDER FOR GUIDED MENU

BACKGROUND OF THE INVENTION

The present invention relates to a bookcover-like container or folder for a guided menu.

More particularly, the present invention relates to a bookcover-like folder or container to be employed in first-rate restaurants and which is suitable to contain coupled bills of fare describing wines and food.

As in well known, the popularity of learning about culture through native cuisine has increased continuously in the recent years, and new culinary creations developed in foreign countries are also continuously increasing.

In a similar way, managers and restaurant directors are increasingly searching for places which are particularly attractive to start new businesses which offer food prepared with original and refined culinary techniques in a sophisticated environment.

The research of drinks that best compliment a given food is consequent to the creation of new dishes according to new refined culinary techniques, and the suggestion of which food and which drink best compliment each other is thus desirable in a dining situation.

Very often the customers of such new first-rate restaurants are unable to determine which of the various courses are best complimented by which of the wines which are to accompany the same. Moreover, restaurants located in particularly interesting sites due to historical or panoramic reasons quite often become the destination of foreign people invited by local hosts to share an enjoyable culinary, cultural or environmental experience.

In such cases it is desirable by such customers to find both historical or environmental information and precise directions about which wine best compliments which food and which combinations are best suited to various occasions and to the particular day, with the various combinations satisfying the tastes of a very wide range of customers, in a single folder.

A drawback of standard bills of fare or "menus" circulating at the present time in restaurants is the difficulty in reading the same caused by printing the information with a very small size type or by writing such information manually. On the other hand, such reading difficulty is also caused by the fact that the evening customers of first-rate restaurants quite often purposely or inadvertently forget their reading glasses so that the choice of food and the complimentary association of the same with drinks becomes impossible or at least very hard to determine for these customers from the menu.

Accordingly, it is evident that there is a need for a guide bearing directions of the possible combinations of wine and food together with a reading key for determining such combinations, a guide to the preparation of dishes, and finally, historical and cultural information about the environment in which the restaurant is located.

SUMMARY OF THE INVENTION

In order to satisfy such a need, the present invention comprises a bookcover-like folder or container which is divided into a first portion in which a list of food items is provided which are to be accompanied by different drinks, which are listed on a portion adjacent to the first one, according to some advisable schemes, and so as to contain on a first-opening portion containing both the directions for consulting the menu and for determining the most appropriate complimentary association between the food and drinks. The container is also provided with a magnifying instrument for making the reading thereof easier.

Accordingly, it is a specific object of the present invention to provide a bookcover-like container or folder for a guided menu, said container or folder being characterized in that it comprises an upper and a lower sheet, such sheets being joined together by a lateral rigid ribbing, on the inside part of which the menu is provided. The folder also comprises a supplemental sheet having the same size as the lower sheet, said supplemental sheet being extractable from the inside part of the same wherein the drinks are listed which are to compliment the food items on the menu, and another bookcover-like container provided on the outside surface of said first sheet and inside of which, on a first inside surface, technical directions are listed for determining the complimentary association between the food items on said menu and the drinks, whereas the information about cultural features is provided on a second inside surface.

According to a further embodiment of the present invention, said bookcover-like folder or container for a guided menu has a chain-like means for supporting a magnifying lens adjacent one of the ends of said lateral ribbing.

Moreover, according to a preferred embodiment of the invention, two closing members are provided on the outside surface of said upper sheet, such members being rotatable in a button-like way for fastening the additional bookcover-like container in a closed position.

BRIEF DESCRIPTION OF THE DRAWINGS

The present invention will be disclosed in an illustrative and not a limitative manner with reference to the accompanying drawings, wherein.

DETAILED DESCRIPTION OF THE PREFERRED EMBODIMENT

Figure 1:
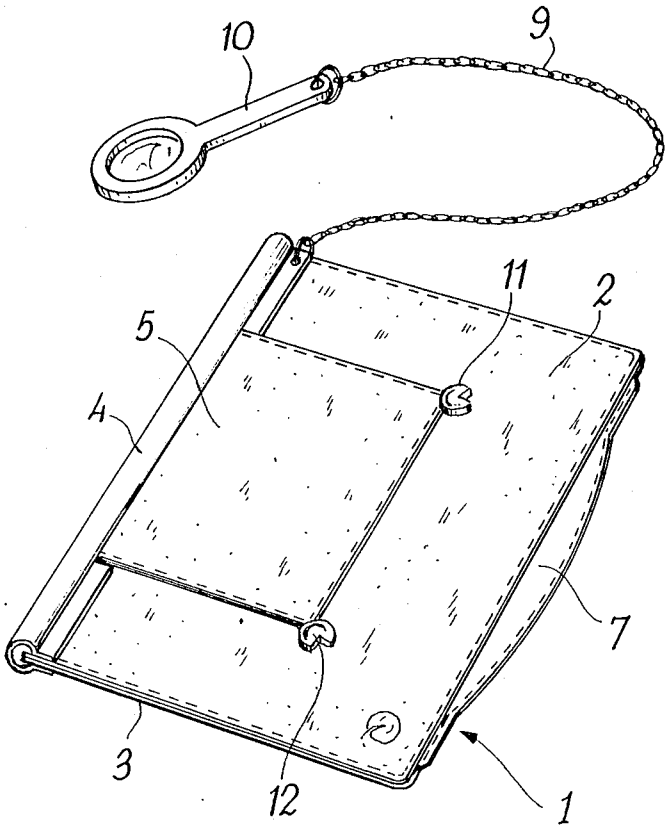
FIG. 1 is a perspective view of the menu-bearing container or folder according to the present invention, in a closed position thereof.

As can be seen in FIG. 1, the bookcover-like folder or container 1 consists of an upper sheet 2, and a lower sheet 3 (only the edge of the same is visible) with the sheets being kept together by a rigid ribbing 4. A cavity is provided in the middle part of said ribbing 4 in which cavity the bookcover-like folder or container in inserted, the folder also being formed by an upper sheet 5 and by a lower sheet 6. Moreover, a convex portion of a handle 7 of an extractable sheet 8 can also be seen in FIG. 1, the same being completely shown in FIG. 3.

A small chain 9 bearing a magnifying lens 10 for making reading of the menu easier is attached to the upper end of the lateral ribbing 4.

Figure 2:
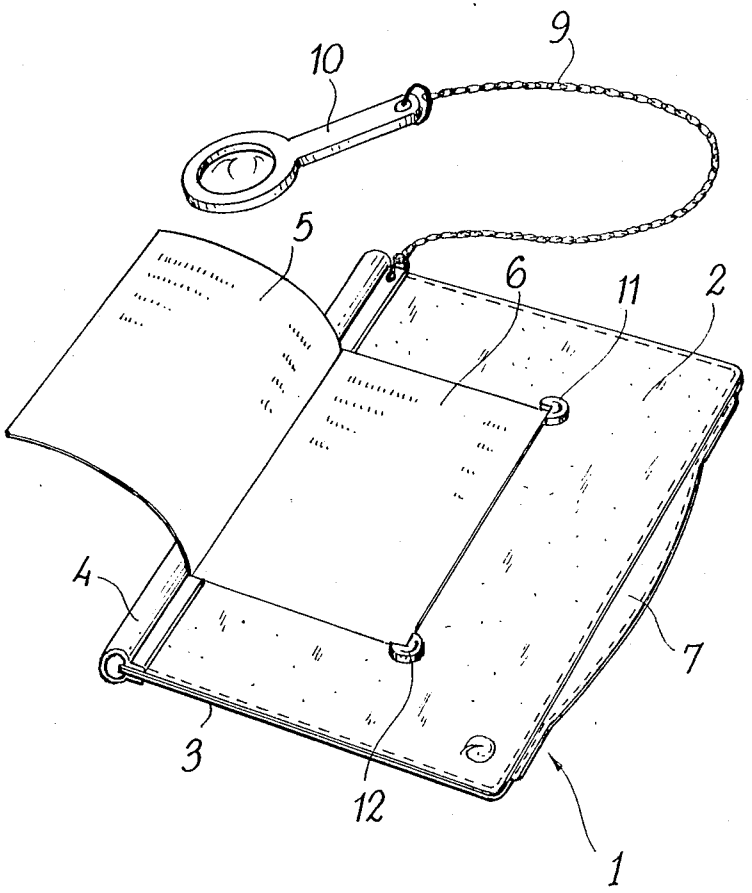
FIG. 2 is a perspective view of the menu-bearing folder or container according to the present invention, with the upper, smaller-size bookcover-like container or folder in an open position thereof.

FIG. 2 shows the inside part of sheets 5 and 6 on which directions are printed describing the proper wine to compliment particular food as well as the historical and cultural information concerning the restaurant and the area in which the restaurant is located.

Directions for choosing suitable drinks that compliment the culinary creations described inside the container or folder 1 are provided in the form of a legend explaining the symbols and the interlacing of the printed lines on the inside of the same.

As is clearly evident from FIG. 1 and FIG. 2, the sheets 5 and 6 are kept in a closed position by two generally circular buttons 11 and 12 having recessed portions, which recessed portions when moved over the edges of the sheets allow the sheets 5 and 6 to be opened.

Figure 3:
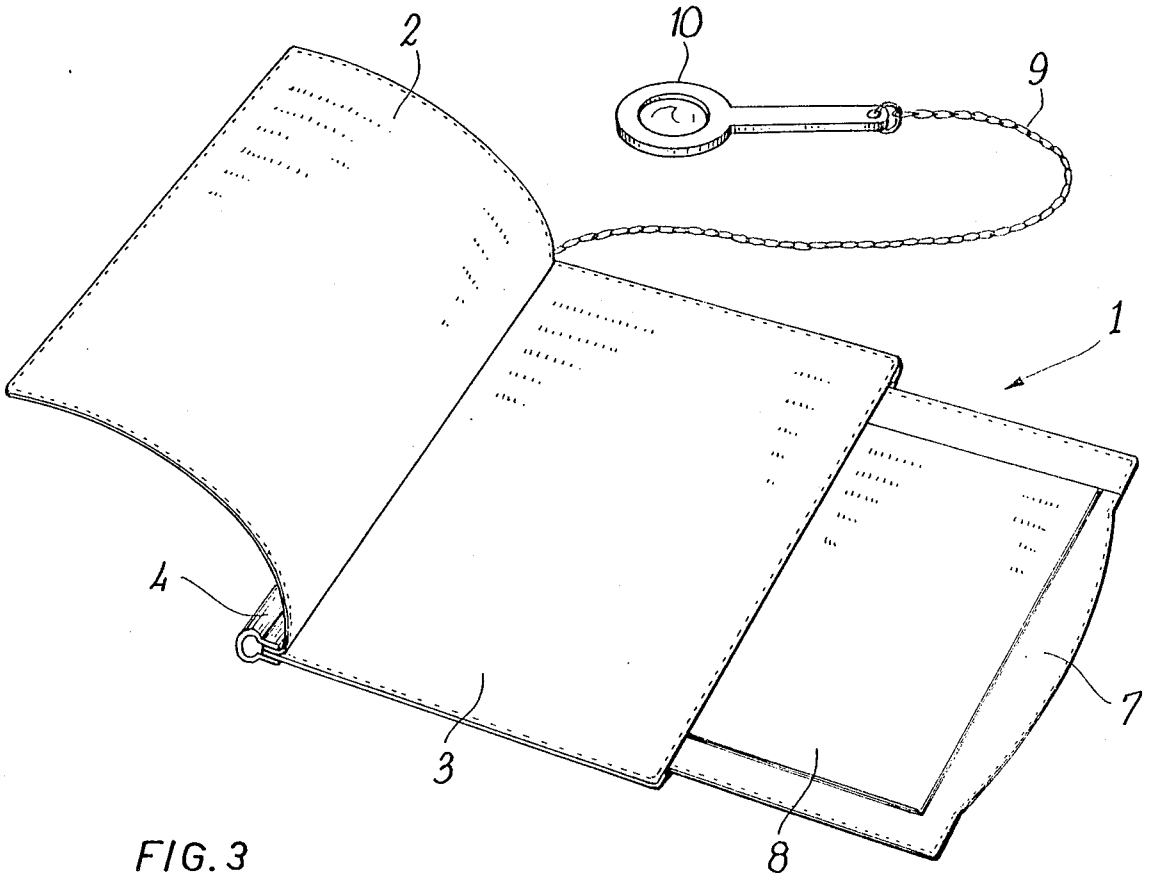
FIG. 3 is a perspective view of the menu-bearing folder or container in the open position with the extractable sheet in a completely extracted position.

FIG. 3 shows the device 1 fully open, with the extractable sheet 8 completely out of its inside housing.

Lists of food items are printed on the sheets 2 and 3, said food items being arranged according to various combinations, while the lists of the wines and drinks that compliment the food items are provided on the sheet 8.

For a better graphic representation, both the food lists and the drink lists with the crossing lines referencing the various proper complimentary associations of the same are not shown in the Figure.

The present invention has been disclosed for illustrative but not for limitative purposes, and it is to be understood that modifications and changes can be introduced in the same without departing from the spirit and scope of the invention for which a priority right is claimed.

I claim:

1. A folder for containing the information of a menu, said folder comprising:

a flexible upper sheet having inner and outer surfaces;

a flexible lower sheet having an inner surface, an outer surface and a recess defined therein between the inner and outer surfaces thereof;

a rigid rib securing said upper sheet to said lower sheet along respective corresponding lateral edges thereof so that said upper sheet, said lower sheet and said rib collectively define a first folder-like section, the inner surfaces of said upper and said lower sheets facing each other in a closed position of said first folder-like section, and said first folder-like section being openable from said closed position to an open position thereof at which the inner surfaces of said upper and said lower sheets are flexed away from each other;

a supplemental sheet disposed in the recess of said lower sheet and removable therefrom;

a second folder-like section disposed on and secured relative to the outer surface of said upper sheet of said first folder-like section, said second folder-like section comprising a first sheet having inner and outer surfaces, and a second sheet having inner and outer surfaces, said first sheet being joined to said second sheet along corresponding lateral edges thereof, the inner surfaces of said first and said second sheets facing each other in a closed position of said second folder-like section, said second folder-like section being openable from said closed position thereof to an open position at which the inner surfaces of said first and said second sheets are disposed away from each other; and two button-like closing members rotatably mounted to the outer surface of said upper sheet and rotatable between engaging and disengaging positions, said closing members engaged with said second folder-like section when in said engaging position for maintaining said second folder-like section in said closed position thereof, and said closing members being out of engagement with said second folder-like section when in said disengaging position.

2. A folder as claimed in claim 1, and further comprising a magnifying lens and a chain-like supporting means for securing said magnifying lens to said first folder like section, said chain-like supporting means having a first end fastened adjacent an end of said rigid rib and a second end fastened to said magnifying lens.

3. A folder is claimed in claim 1, wherein the inner surfaces of said upper and said lower sheets of said folder-like section, said inner surfaces of said first and said second sheets of said second folder-like section, and said supplemental sheet are provided with dining information.

* * * * *